United States Patent [19]

Theurer

[11] Patent Number: 4,643,101

[45] **Date of Patent: * Feb. 17, 1987**

[54] MOBILE TRACK LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[ * ] Notice: The portion of the term of this patent subsequent to Aug. 13, 2002 has been disclaimed.

[21] Appl. No.: 607,207

[22] Filed: May 4, 1984

Related U.S. Application Data

[63] Continuation-in-part of Ser. No. 498,261, May 26, 1983, Pat. No. 4,596,193.

[30] Foreign Application Priority Data

Nov. 23, 1982 [AT] Austria ..... 4266/82
Sep. 9, 1983 [AT] Austria ..... 3223/83

[51] Int. Cl.[4] ..... E01B 27/17
[52] U.S. Cl. ..... 104/7.2; 104/12
[58] Field of Search ..... 104/2, 7 R, 7 B, 12

[56] References Cited

U.S. PATENT DOCUMENTS 3,494,297 2/1970 Plasser et al. ..... 104/7 B
3,595,170 5/1971 Plasser et al. ..... 104/12
3,795,198 3/1974 Plasser et al. ..... 104/12
4,046,078 9/1977 Theurer ..... 104/7 R
4,046,079 9/1977 Theurer ..... 104/7 R
4,356,771 11/1982 Theurer ..... 104/7 B
4,399,753 8/1983 Theurer et al. ..... 104/7 B

FOREIGN PATENT DOCUMENTS 2094378 of 1892 United Kingdom .
2077821 12/1981 United Kingdom .

*Primary Examiner*—Randolph A. Reese
*Attorney, Agent, or Firm*—Kurt Kelman

[57] ABSTRACT

A mobile track leveling, lining and tamping machine comprising a main machine frame supported on undercarriages spaced apart in the direction of the track for mobility on the track in an operating direction, the track consisting of two rails fastened to successive ties resting on ballast; an operating unit comprised of a separate carrier frame supporting a ballast tamping assembly and a track leveling and lining assembly forwardly of the ballast tamping assembly, in the operating direction; a pivotal bearing supporting a front end of the operating unit on the machine frame; and a track stabilization assembly mounted on the main machine frame between the operating unit and a succeeding one of the undercarriages supporting the main machine frame on the track.

25 Claims, 12 Drawing Figures

Fig. 3
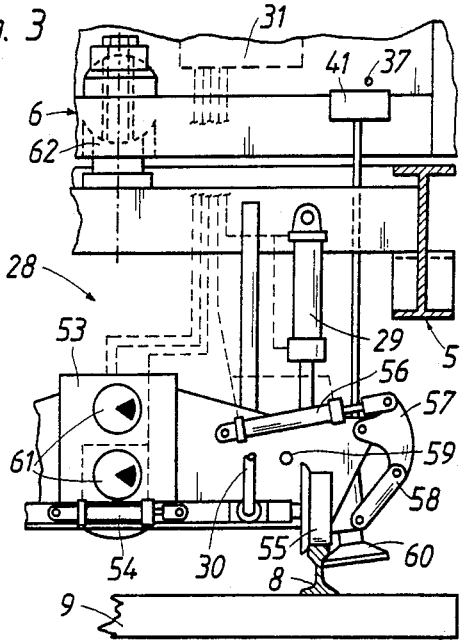
Fig. 4
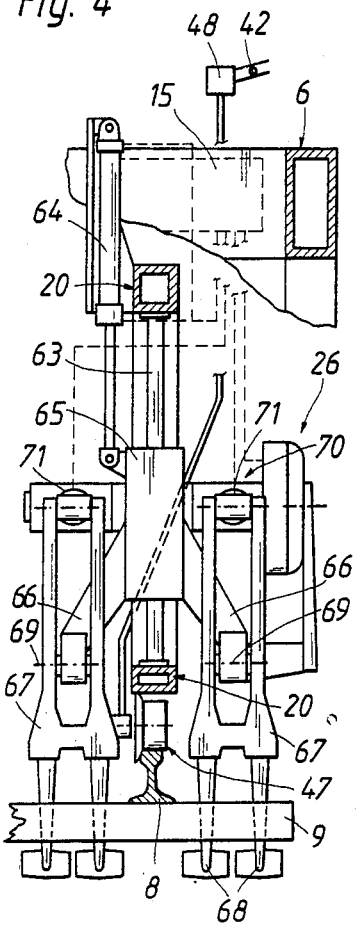
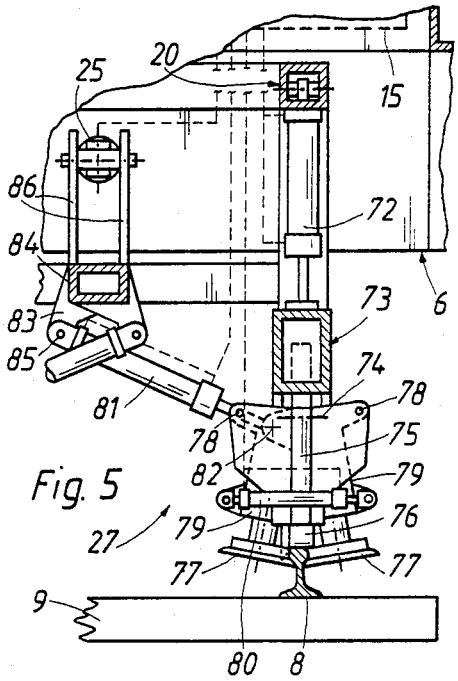
Fig. 5

MOBILE TRACK LEVELING, LINING AND TAMPING MACHINE

This is a continuation-in-part of my copending patent application Ser. No. 498,261, filed May 26, 1983, now U.S. Pat. No. 4,596,193.

The present invention relates to a mobile track leveling, lining and tamping machine incorporating a ballast tamping assembly, a track leveling and lining assembly and a track stabilization assembly.

U.S. Pat. No. 4,457,234 filed Apr. 13, 1981, discloses a track tamping, leveling and lining machine with a track leveling and lining assembly having a bogie with a rear portion supporting the leveling and lining tools and a pole projecting forwardly from the rear portion. A ballast tamping assembly is mounted on the machine frame separately from the track leveling and lining assembly bogie and this bogie has its front end universally linked to the machine frame while the rear bogie portion is universally linked to the machine frame by the lifting drives. A pair of lining rollers mounted between pairs of lifting rollers supports and guides the bogie on the track. This arrangement assures a secure and stable engagement of the lifting and lining rollers with the track rails and an automatic centering thereof with respect to the rails, particularly in track curves.

U.S. Pat. No. 4,430,946 filed Oct. 21, 1981, discloses a machine of this type wherein the ballast tamping assembly and the track leveling and lining assembly are separately mounted on the machine frame between the front and rear undercarriages thereof. The sequential arrangement of the tamping and stabilization assemblies provides an excellent stabilization of the tamped ballast for long-lasting support of the leveled and lined track because the effective operating ranges of the tamping tools and the track stabilization overlap.

U.S. Pat. No. 4,046,078, dated Sept. 6, 1977, discloses a mobile track surfacing machine equipped with a dynamic track stabilization assembly mounted between the undercarriages supporting the machine frame for mobility on the track. Such machines are coupled to intermittently advancing track leveling, lining and tamping machines for settling the ballast and compacting the same further after the track has been leveled, lined and tamped. The structure, operation and advantages of such dynamic track stabilization has been fully disclosed in this patent whose disclosure is incorporated herein by reference.

U.S. Pat. No. 4,356,771, dated Nov. 2, 1982, discloses a self-propelled track working machine comprising two vehicles moved along the track by respective drives. Track working tools, including tamping tools, as well as a television camera for viewing selected tools are mounted on one of the vehicles between two undercarriages supporting the one vehicle for mobility on the track. This is a standard mobile track leveling, lining and tamping machine. The other vehicle is a control vehicle mounting a monitoring and control panel out of sight of the selected tools and the television camera is connected to a television screen on the panel to enable an operator there to view the operation of the tools. The drive for the one vehicle moves the one vehicle intermittently from tie to tie while the drive for the other vehicle moves the other vehicle non-stop ahead of the one vehicle, a control between the vehicles keeping the other vehicle at a constant speed and a desired distance from the one vehicle. The operator at the monitoring and control panel is not subject to the vibrations and the stop-and-go movement of the track tamper, thus enhancing his comfort, while the tamper, which carries the drive, brake and power plant means, is subject to the intermittent shocks and vibrations encountered in track tamping machines. The additional control vehicle, with its remote controls and televised monitoring of the machine operations, makes this apparatus quite expensive so that it can be economically used only for extensive track work, such as new track constructions or building of high-speed track, where the ties are uniformly spaced and the ballast bed is also uniform, allowing the machine advance and the control of the operating tools to be automated so that the operator can work the controls on the basis of the televised picture of the work being performed on the track by the tools and does not require an operator within direct sight of the working tools.

In the development of non-stop track tampers, it has been found desirable to reduce or substantially eliminate the considerable wear of essential components of the machine and the physical strain on the operating personnel due to the constant stop-and-go movement necessarily connected with the intermittent advance of the tamping tools between successive cribs in which the tools are immersed during each tamping stage. In the track leveling and lining machine of U.S. Pat. No. 3,795,198, dated Mar. 5, 1974, the track tamper frame advances continuously while the tamping tool assemblies are mounted on the frame for movement relative to the movement of the frame in synchronization with the machine frame advance so that the tamping tool assemblies are held in respective cribs while they tamp the ballast during the continuous advance of the machine frame. After the completion of each tamping stage, the tamping tool assemblies must be rapidly advanced along their guides until they are properly centered over the next tie to be tamped and the next tamping stage is then initiated by lowering the tamping tool assemblies for immersion of the tamping tools in the cribs adjacent the tie to be tamped. The frame of such a machine must be sufficiently massive and stress-resistant to support not only the loads and vibrations of the tamping assemblies and their guides but also those of the track lifting and lining unit mounted thereon. Such a machine has not been built for commercial operations.

An advertisement in "Der Eisenbahningenieur", No. 6, June 1983, and a substantially corresponding and concurrently published pamphlet by the inventor's assignee, entitled "09-CSM Continuous action tamping machine", discloses a prototype of a non-stop operating track leveling, lining and tamping machine, as described in my copending U.S. Pat. No. 4,534,295, issued Aug. 13, 1985 and U.S. Pat. No. 4,596,193, issued June 24, 1986. This machine for the first time solved the problems encountered in the development of non-stop track tampers and provided a commercially feasible tamper of this type. The success of this machine has been experimentally proved in tests on tracks in Austria and other European countries. The continuously advancing heavy main machine frame of the machine supports the drive, brake and control means as well as the power plant, while the lighter carrier frame, which is pivotally coupled to the main frame by an adjustment drive, supports the ballast tamping and track leveling and lining assemblies and advances intermittently. A support and guide carriage supports a rear end of the carrier frame adjacent the tamping tool assembly on the track so that a considerable portion of the weight and the working forces of the tamping, lifting and lining tools is transmitted to the track through the support and guide carriage, thus relieving the main frame and subjecting the same to considerably less static and dynamic loads than the frame of the machine disclosed in U.S. Pat. No. 3,795,198, for example. Also, the operator in the cab on the main frame is not subject to the vibrations of the tamping tools or the shocks of intermittent braking, thus considerably improving the working conditions.

It is the primary object of this invention to improve mobile track leveling, lining and tamping machine with a track stabilization assembly by effectively mounting all operating tools so that they always automatically follow the track whereby the durability and the firm positioning of the track leveled, lined, tamped and stabilized with the machine is enhanced.

It is a more particular object of the invention to provided a non-stop advancing machine of this type.

The above and other objects are accomplished according to the present invention with a mobile track leveling, lining and tamping machine comprising a main machine frame supported on undercarriages spaced apart in the direction of the track for mobility on the track in an operating direction, the track consisting of two rails fastened to successive ties resting on ballast; an operating unit comprised of a separate carrier frame means supporting a ballast tamping assembly and a track leveling and lining assembly forwardly of the ballast tamping assembly, in the operating direction; a pivotal bearing supporting a front end of the operating unit on the machine frame; and a track stabilization assembly mounted on the main machine frame between the operating unit and a succeeding one of the undercarriages supporting the main machine frame on the track.

Compared to conventional machines incorporating track leveling, lining, tamping and stabilizing assemblies, the machine of this invention is surprisingly simple in structure and operation. The four different assemblies are readily operated in the desired sequence so that the accuracy and durability of the effected track positioning are greatly increased while simultaneously enhacing the output of the machine and the comfort of the operating personnel.

When incorporating the non-stop operation principle of a track leveling, lining and tamping machine, the combined machine of the invention has all four operating assemblies so arranged on the non-stop advancing main machine frame and the intermittently advancing operating unit, respectively, that they meet all technological requirements for the track work performed thereby. The exceptional durability of the corrected track position is due primarily to the fact that this track position is first obtained by the track leveling, lining and tamping assemblies as the operating unit advances step-by-step and is then dynamically stabilized by the immediately following track stabilization assembly which advances continuously with the main machine frame which is supported for mobility on the track by an undercarriage running between the operating unit and the track stabilization assembly and subjecting the corrected track to a continuous, relatively high load, thus fixing the corrected track in its position and pressing the track ties against the corrected ballast support. In the zone between this undercarriage and a succeeding undercarriage supporting the main frame on the track, the previously corrected and fixed track is then "rubbed into" the ballast by the continuously advancing track stabilization unit in a manner designed to stabilize the track dynamically without stress on the track. The two undercarriages of the main machine frame, wherebetween the track stabilization assembly is mounted on the main machine frame, form two fixed supports for the track, which advance continuously with the machine and which are sufficiently spaced in the direction of the track to permit the track to be subjected to vibrations of an amplitude imparted thereto by the vibrator drive of the track stabilization assembly.

The above and other objects, advantages and features of the present invention will become more apparent from the following detailed description of certain now preferred embodiments, taken in conjection with the accompanying, partly schematic drawing wherein FIG. 1 is a side elevational view of one embodiment of a mobile track tamping, leveling and lining machine with a track stabilization assembly according to this invention;

FIG. 3 is an enlarged end view of the track stabilization assembly, along line III—III of FIG. 1;

FIG. 4 is a like view of the tamping tool assembly, along line IV—IV of FIG. 1;

FIG. 5 is a like view of the track leveling and lining assembly, along line V—V of FIG. 1;

Figure 1:
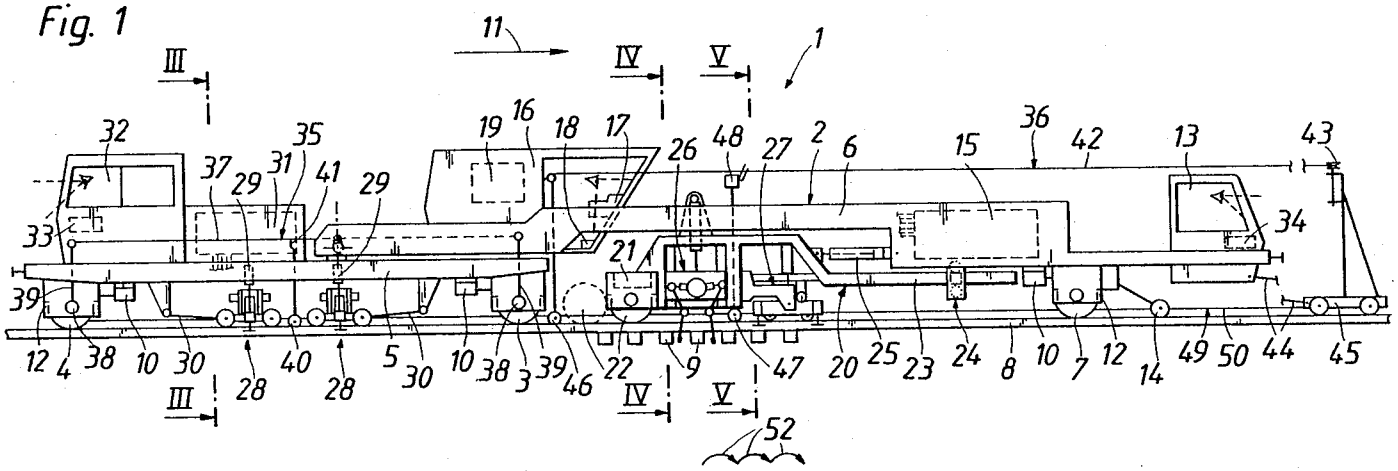
Figure 2:
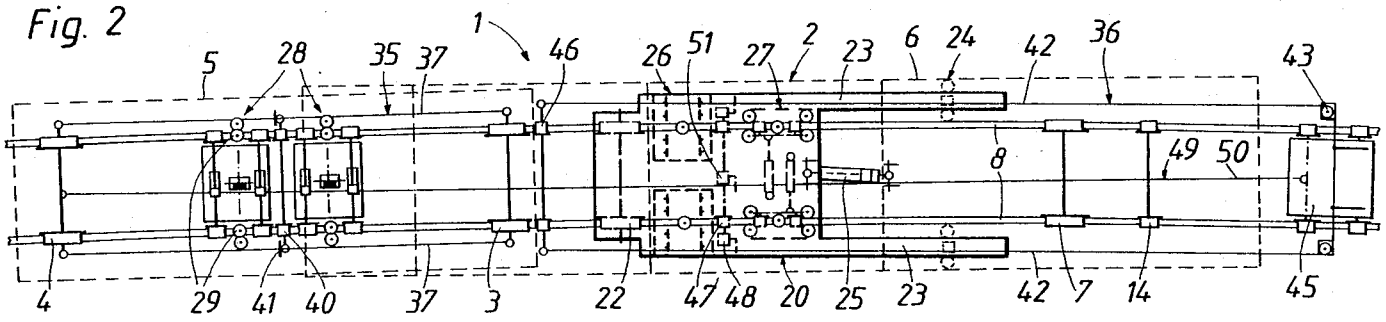
FIG. 2 is a greatly simplified view thereof, the main machine frame being shown in broken lines.

Referring now to the drawing and first to FIGS. 1 to 5, there is shown mobile track leveling, lining, tamping and stabilizing machine 1 which comprises heavy main machine frame 2 supported on 3, 4 and 7 spaced apart in the direction of the track for mobility on the track in an operating direction indicated by arrow 11. The track consists of two rails 8 fastened to successive ties 9 resting on ballast (not shown). The machine has an operating unit comprised of separate carrier frame means 20 supporting ballast tamping assembly 26 and track leveling and lining assembly 27 forwardly of the ballast tamping assembly, in the operating direction. Pivotal bearing 24 supports a front end of the operating unit on the machine frame. Track stabilization assembly 28 is mounted on main machine frame 2 between the operating unit and succeeding undercarriage 4 supporting the machine frame on the track.

The illustrated embodiments are non-stop operating machines and, as shown in FIG. 1, drives 10 are connected to front undercarriage 7, the one undercarriage 3 between the operating unit and the track stabilization assembly and rear undercarriage 4 for continuously and non-stop advancing main machine frame 2 in the operating direction, the track stabilization assembly being mounted on the main machine frame for continuous and non-stop movement therewith. The undercarriages are equipped with brake means illustrated as brake shoes 12. The operating unit is mounted for adjustment in relation to the main machine frame, and adjustment drive 25 is arranged to adjust the operating unit in relation to the main machine frame for intermittently advancing the operating unit while the main machine frame advances continuously.

In the embodiments shown in FIGS. 1 to 9, one of the undercarriages supporting the main frame for mobility on the track is positioned between the operating unit and the track stabilization assembly mounted on the main machine frame for movement therewith. As shown in FIG. 1, the one undercarriage 3 and succeeding undercarriage 4 immediately follow each other and are spaced relatively far apart in the direction of the track.

In the embodiment of FIG. 1, main machine frame 2 comprises, in the operating direction, rear frame part 5 extending between the one undercarriage 3 and succeeding undercarriage 4, two succeeding ones of track stabilization assemblies 28, 28 being mounted on the rear frame part, and long front frame part 6 extending between the one undercarriage 3 and front undercarriage 7 in the direction of the track. The long front frame part has a rear end pivotally supported on the rear frame part whereby the main machine frame is articulated in the direction of the track and a front end supported on front undercarriage 7. The operating unit is pivoted to the front frame part between the front and rear ends thereof. This specific structure has several advantages. In the first place, the rear frame part carrying the track stabilization assembly or assemblies may be a conventional track stabilization machine, such as shown in U.S. Pat. No. 4,046,078. In the second place, the articulated main machine frame enables the machine to move without difficulty even in tight curves. Finally, the rear frame part receives the additional weight of the front frame part supported thereon, thus increasing the vertical load on the track during dynamic stabilization of the ballast, which enhances the stabilizing effect.

As shown, a pivotal support on rear frame part 5 is substantially centered between the ends of the rear frame part and above one of the track stabilization assemblies for pivotally supporting the rear end of long front frame part 6 on the rear frame part. This corresponds essentially to supporting the long front frame part on a swivel truck, with a relatively long wheelbase, which is a very advantageous arrangement for the mobility of the machine on the track, particularly at high speeds. Furthermore, the weight of the front frame part is transmitted to the rear frame part exactly at the point where it is most desired, i.e. where the vertical loads are applied to the track stabilization assembly for settling and compacting the ballast.

Central operator's cab 16 is mounted on the main machine frame within direct sight of the ballast tamping, track leveling and lining and track stabilization assemblies, and additional operator's cabs 13 and 32 are mounted respectively at the front and rear ends of main machine frame 2, with free views of the track in front and back of the main machine frame. Control means 33 and 34 for main machine frame drives 10 and brake means 12 respectively connected to undercarriages 3, 4 and 7 are mounted on the additional operator's cabs. Control means 33 may also serve to operate the track stabilization assemblies. This arrangement enables the machine to be operated without difficulty even if the main machine frame is very long, for example if the ballast tamping assembly is designed for the simultaneous tamping of several successive ties, since it assures a clear view of the entire track when the machine is moved between working sites.

Odometer means 14 is arranged at front undercarriage 7 to measure the distance of the machine's advance along the track. Power plant 15 for the various machine drives is mounted on front frame part 6 behind the front undercarriage ahead of the track leveling and lining assembly. This arrangement has the advantage that sufficient space is available for accommodating all the drives and other structural components of the operating unit while enabling the same to move longitudinally with respect to the main machine frame. Central operator's cab 16 is mounted on long front frame part 6 between track stabilization assemblies 28 and ballast tamping and track leveling and lining assemblies 26, 27. Cab 16 projects forwardly from a front end of rear frame part 5 in the operating direction and is arranged within direct sight of the assemblies. Central drive and control panel 17, brake pedal 18 and control 19 are mounted in the central operator's cab for operation of the machine. Since the operator's cabs are mounted on the continuously advancing main machine frame, the operators are not subjected to the impacts emanating from the operation of the tamping, leveling and lining tools on the separate operating unit and the stop-and-go movements of this unit while being able to monitor and control all operations.

The operating unit is comprised of separate carrier frame 20 supporting ballast tamping assembly 26 and track leveling and lining assembly 27 forwardly of the ballast tamping assembly, in the operating direction. Single-axle support and guide carriage 22 supports a rear end of the operating unit on the track. The carriage is equipped with drive 21, assemblies 26, 27 are mounted between carriage 22 and undercarriage 7 preceding the same in the operating direction, and the carriage immediately precedes the one undercarriage 3 in the operating direction. Carrier frame 20 has two elongated parallel booms 23 longitudinally adjustably and pivotally supported in roller guides 24 mounted on front frame part 6 so that the carrier frame may swivel from side to side and move in the direction of the track in relation to the main machine frame. The adjustment drive for the operating unit is a longitudinally adjustable coupling consisting of double-acting hydraulic cylinder-and-piston device 25 pivotally connecting the carrier frame to the front frame part and having an adjustment path corresponding to the path of intermittent advancement of the operating unit and about twice the distance between successive ties. This arrangement contributes to a trouble-free operation of the machine and simplifies the entire operation because the track stabilization assembly on the main machine frame and the ballast tamping and track leveling and lining assemblies on the operating unit are each driven separately along the track on their respective frames supporting them while the tamping tools are always properly centered with respect to their associated rails when the machine travels in track curves. At the same time, the main machine frame is fully relieved of the load and work forces of the track working tools on the separate operating unit.

The two track stabilization assemblies 28, 28 are centered on rear frame part 5 and are connected thereto, on the one hand, by vertical load applying drives 29, 29 and, on the other hand, by connecting rods 30, 30 linking the assemblies to the rear frame part for movement therewith in the direction of the track. Power plant 31 for operating the track stabilization assemblies is mounted on rear frame part 5 between the one undercarriage 3 and succeeding undercarriage 4 and drives 10 for continuously advancing the main machine frame are connected to undercarriages 3 and 4 and are mounted on the main machine frame therebetween. This arrangement has the considerable advantage that the rear frame part can be disconnected and operated as an independent machine with its own power plant and drive, for example when the operating unit connected to the front frame part requires extended maintenance work.

A separate leveling reference system 35, 36 is associated with each frame part 5, 6. Reference system 35 of rear frame part 5 is comprised of respective tensioned wires 37 associated with respective rails 8, the front and rear ends of the tensioned wires being respectively supported on rods 39 mounted on axle bearings 38 of undercarriages 3 and 4. Track sensing element 40 is guided along the track between track stabilization assemblies 28, 28 and carries respective contact plate 41 associated with each tensioned reference wire. Reference system 36 of front frame part 6 is also comprised of two tensioned wires 42 associated with the respective rails. Front ends of the reference wires are reeled on tensioning roller 43 supported on front bogie 45 linked by spacing rod 44 to the front end of the main machine frame. The rear ends of tensioned reference wires 42 are supported on track sensing element 46 guided on the track just ahead of undercarriage 3. Another track sensing element 47 is mounted on carrier frame 20 between ballast tamping assembly 26 and track leveling and lining assembly 27 and carries a respective track level measuring sensor 48, such as a rotary potentiometer, associated with each reference wire 42. The machine is also equipped with lining reference system 49 constituted by tensioned reference wire 50 extending between front bogie 45 and rear undercarriage 44 of machine 1. Lining sensor 51 connected with track level sensor 47 cooperates with reference wire 50 for controlling the lining of the track.

FIG. 1 shows the forward end position of carrier frame 20 in full lines while its rearmost end position is shown in broken lines. The intermittent advance of the carrier frame from tie to tie, i.e. from tamping stage to tamping stage, in relation to the continuous advance of the main machine frame is indicated by arrows 52, this intermittent movement being imparted to the operating unit by adjustment drive 25 and/or drive 21 propelling the carrier frame.

FIG. 3 illustrates the structure of track stabilization assembly 28. This assembly comprises chassis 53, guide roller means 55, 60 firmly holding the chassis in engagement with track rails 8 and mounting the chassis for mobility on the track, vibrator drives 61 imparting essentially horizontal vibrations to the chassis and the track firmly held thereby, and power drive 29 connecting the chassis to the main machine frame and arranged to impart essential vertical load forces to the chassis and the track firmly held thereby. Specifically, flanged wheels 55 of the chassis are pressed tightly against the two track rails by spreading drive means 54 to engage the gage sides of the rail heads. These flanged wheels cooperate with flanged gripping rollers 60 which may be pivoted by pivoting drive 56 about fulcrum 59 to subtend and engage the field side of the rail heads, intermediate pivotal links 57, 58 connecting the flanged rollers to their pivoting drives. In this manner, the track is firmly clamped between flanged wheels 55 and flanged rollers 60 while being vibrated in a horizontal plane transversely to the direction of the track by vibrator drives 61 mounted centrally on chassis 53 and being pressed down into the ballast by drives 29. FIG. 3 also shows pivotal support 62 for supporting a rear end of front frame part 6 above track stabilization unit 28 for universal movement on rear frame part 5. The hydraulic conduits connecting drives 29, 54 and 61 to power plant 31 are indicated in broken lines. The arrangement of the track stabilization assembly on the rear frame part which also supports the power plant therefor not only shortens the conduits connecting the track stabilization assembly drives with the power plant but also provides a very favorable weight distribution.

FIG. 4 illustrates tamping tool assembly 26 in its immersed position. This is substantially a conventional tamping head comprising tamping tool carrier 65 and drive 64 for vertically adjusting the tamping tool carrier along two guide columns 63 wherealong the carrier glides, each tamping tool carrier being centered above respective rail 8 of the track. Pairs of vibratory and reciprocatory tamping tools 67 are mounted on arms 66 of the tamping tool carrier for immersion in successive cribs, the arms and tamping tools mounted thereon straddling the respective rail and a respective tie 9 being positioned between the tools of the pairs. Each tamping tool carries two tamping jaws 68 and is mounted on pivot 69 extending transversely to the rails so that the lever-like tamping tools may be reciprocated about the pivot in the direction of the track towards and away from the interposed tie. Only one of the tamping tools of each pair is visible in the end view of FIG. 4. Hydraulic drives 71 are linked to the upper ends of the tamping tools of each pair for reciprocating the tools, the reciprocating drives being connected to cam shaft drive 70 for vibrating the reciprocating tools. In this figure, too, hydraulic conduits connecting drives 64, 70 and 71 to power plant 15 are schematically indicated in broken lines.

FIG. 5 illustrates track leveling and lining assembly 27 which also is essentially of standard structure. It comprises track engaging track lifting and lining tools 76, 77 and drives 72 and 81 for moving the tools respectively in a vertical and transverse direction for leveling and lining the track. Specifically, assembly 27 comprises, for each rail 8, tool carrier 73 vertically movable by drive 72 and having tool carrier part 75 pivotal about axis 74 and guided along the respective rail by two flanged lining rollers 76 spaced from each other in the direction of the track. Pairs of cooperating lifting rollers are mounted at the front and rear ends of tool carrier part 75 and the lifting rollers are pivotal about axes 78 extending in the direction of the track for clamping the respective rail 8 therebetween. Bearings 79 of the lifting rollers are linked together by clamping drive 80 so that the two lifting rollers of each pair may be moved towards each other to subtend the rail head with their flanges. Lining drives 81 are linked to tool carrier part 75 and bracket 83 of central longitudinal boom 84 of carrier frame 20, respectively, universal joints 82 and 85 connecting the respective ends of drives 81 to the tool carrier part and the bracket. The longitudinal carrier frame boom has two parallel support plates 86, which may be welded to the boom, for supporting a universal joint to which one end of adjustment drive 25 is connected. Again, hydraulic conduits connecting drives 25, 72, 80 and 81 with power plant 15 are shown schematically in broken lines.

As the description of the structure of machine 1 generally shows, the machine operates in the following manner:

With carrier frame 20 of the operating unit in the forward end position shown in full lines in FIG. 1, drives 10 are operated to advance machine 1 in the operating direction indicated by arrow 11 until tamping tool assemblies 26 associated with track rails 8 are suitably centered above the first tie 9 to be tamped. The operator in cab 16 at control panel 17 now switches on vibratory drives 70 and disconnects drive 25 from its hydraulic fluid supply so that the same idles and permits free movement of the carrier frame while main machine frame 2 continues to advance. Lifting and lining drives 72 and 81 are operated in response to control signals generated by reference systems 36, 49 for leveling and lining the track while drives 64 and 71 are operated to lower the tamping tools into the ballast and to reciprocate the tamping tools for tamping the ballast under tie 9. After completion of this generally conventional track leveling, lining and tamping operation, at which time carrier frame 20 is in its rear end position shown in broken lines in FIG. 1, drive 64 is operated to lift the tamping tools out of the ballast while adjustment drive 25 and/or drive 21 is simultaneously operated to advance carrier frame 20 rapidly to its forward end position in which the tamping tools are centered above the next tie to be tamped. To prevent further movement of carrier frame 20 beyond its rear end position predetermined by the adjustment path of drive 25, the distance traveled by the main machine frame is constantly measured by odometer means 14 which generates a corresponding analog or digital control signal, and this signal is transmitted to control 19 in cab 16 to be compared with the maximally permissible displacement path of the carrier frame. When this maximum value has been reached, the control automatically switches drives 10 off and applies the brakes to the undercarriages of main machine frame 2.

As the machine continues to advance in the operating direction, the one undercarriage 3 reaches the leveled, lined and tamped track section and, as the undercarriage, which receives the heavy load of the main machine frame, runs thereover, it produces a further compaction of the ballast. At this point, vibratory drives 61 and drives 29 are operated to impart horizontal vibrations and vertical loads to track stabilization assemblies 28 whereby the ballast is fluidized and so re-orients the ballast stones that they form a denser and firmer support layer for the track. Since the volume of the ballast is thus reduced, the vertical load forces applied thereagainst will settle the track between undercarriages 3 and 4 at its final corrected level. Since the horizontal vibrations move the track back-and-forth with the same amplitude at both sides, the track stabilization does not influence the corrected line of the track. The extent of the lowering of the level of the track by track stabilization assemblies 28 is controlled by leveling reference system 35 in the following manner:

The level of rails 8 between undercarriages 3 and 4 is measured by reference wires 37. As long as one of the contact plates 41 of track level sensing element 40 is in contact with the associated reference wire, drive 29 at that side of the track remains under pressure to apply a vertical load to the track. As the track is thus lowered, together with contact plate 41, the contact is opened and relay-controlled solenoid valves in the reference control circuit comprising the reference wires and contact plates are operated to remove the pressure from the drives. Therefore, to set the desired final track level, it is only necessary to adjust the vertical distance of contact plates 41 from track level sensing element 40 suitably.

Figure 6:
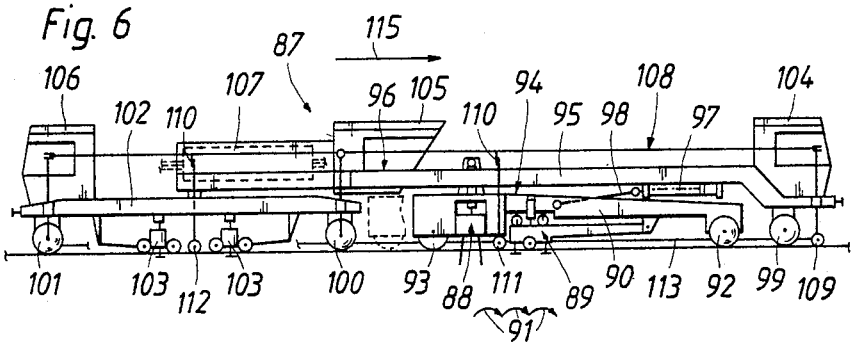
FIG. 6 is a smaller side elevational view of another embodiment of the machine.
Figure 7:
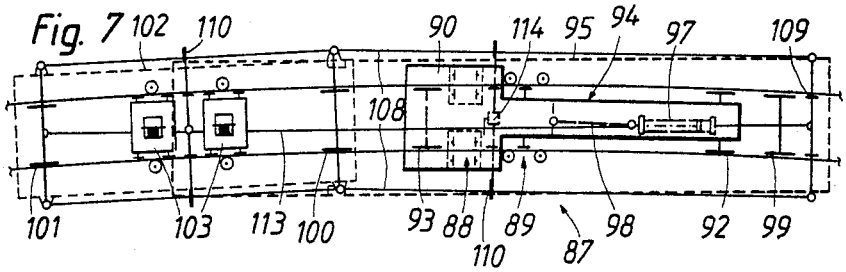
FIG. 7 is a greatly simplified top view thereof, the main machine frame being shown in broken lines.

In the embodiment of FIGS. 6 and 7, the carrier frame means of operating unit 94 of track leveling, lining, tamping and track stabilizing machine 87 is elongated carriage 90 supported for mobility on the track on two undercarriages 92, 93 spaced apart in the direction of the track. The carriage with ballast tamping assembly 88 and track leveling and lining assembly 89 being arranged between the two undercarriages supporting elongated carriage 90. This carriage advances intermittently from tamping stage to tamping stage, as indicated by arrows 91, while main machine frame 94 advances non-stop. Main machine frame 96 is comprised of two articulated frame parts, long front frame part 95 bridging over elongated carriage 90 in the direction of the track. Adjustment drive 97 is a longitudinally adjustable coupling pivotally connecting the elongated carriage to the long front frame part by connecting rods 98 linking carriage 90 to drive 97 and having an adjustment path corresponding to the path of intermittent advancement of the operating unit and about twice the distance between successive ties. Operating unit 94 is arranged between front undercarriage 99 and intermediate undercarriages 100 of main machine frame 96 and the end positions of its adjustment path are indicated in full and broken lines, respectively. A pair of schematically shown track stabilization assemblies 103, 103 are mounted on rear main machine frame part 102 between intermediate undercarriage 100 and rear undercarriage 101 of the main machine frame. The stabilization assemblies are substantially of the same structure as described hereinabove in connection with FIG. 5. Main machine frame 96 carries operator's cabs 104, 105, 106 as well as power plant 107, the latter being mounted rearwardly of central operator's cab 105 on front frame part 95, the latter being supported on rear frame part 103 by a universal joint substantially centrally between undercarriages 100 and 101.

Machine 87 comprising leveling reference system 108 common to track stabilization and track leveling assemblies 103 and 89. The common leveling reference system is arranged for non-stop movement with main machine frame 96 and extends between front and rear undercariages 99 and 101. The reference system comprises respective sensing element 112, 111 guided on each rail for sensing the level of the respective rail within the range of track stabilization assembly 103 and track leveling assembly 89, respectively, sensing elements 112 within the range of the track stabilization assembly moving continuously with this assembly and sensing elements 111 within the range of the track leveling assembly moving intermittently therewith. A front end of the leveling reference system is supported on track level sensing element 109 at front undercarriage 99 while the rear end of the reference system is supported on rear undercarriage 101. Contact plates 110 supported on track level sensing elements 111 and 112 cooperate with the level reference wire of the leveling reference system.

The machine also comprises lining reference system 113 extending from front sensing element 109 to rear undercarriage 101 and lining sensor 114 is connected to sensing element 111 for cooperation with the lining reference wire. The operating direction of machine 87 is indicated by arrow 115 and its operation will be obvious from the preceding description of the operation of the embodiment of FIG. 1.

Figure 8:
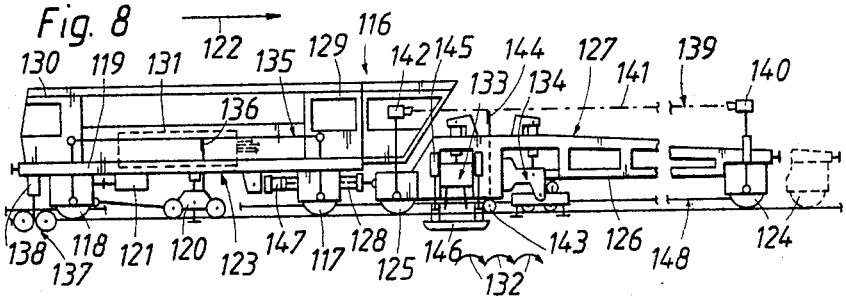
FIGS. 8 and 9 are smaller side elevational and greatly simplified top views, respectively, of a third embodiment of the machine.
Figure 9:
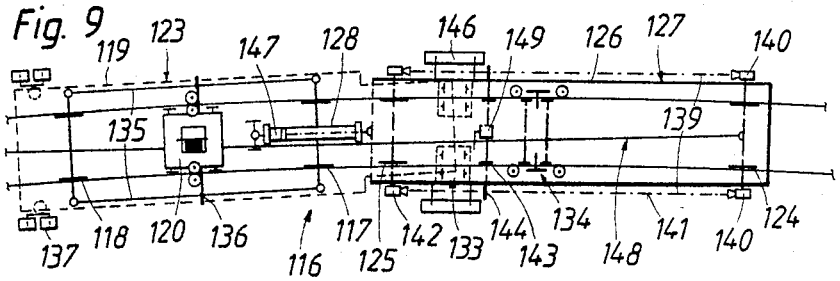

In the embodiment of FIGS. 8 and 9, track leveling, lining, tamping and stabilizing machine 116 comprises main machine frame 123 consisting of single frame part 119 supported for continuous and non-stop advance on front and rear undercarriages 117, 118. A single track stabilization assembly 120 is mounted on the main machine frame between the one undercarriage 117 between operating unit 127 and the track stabilization assembly and succeeding undercarriage 118. Drive 121 is connected to rear undercarriage 118 for continuously advancing the machine in the operating direction indicated by arrow 122. Power plant 131 and control means for track stabilization assembly 120 as well as operator's cabs 129 and 130 are mounted on the main machine frame. Cab 129 projects forwardly from front undercarriage 117 in the operating direction. Operating unit 127 precedes the front undercarriage in the operating direction and two undercarriages 124, 125 support carriage frame means 126 of the operating unit for intermittent advance on the track, as indicated by arrows 132. A rear end of carrier frame means 126 subtends forwardly projecting operator's cab 129. This machine is relatively short and the operator in cab 129 does not only have the tools on the operating unit well in sight but also sees the track ahead of the machine. The operating unit may be uncoupled and the main machine frame may then be used as an independently operating track stabilizer.

Longitudinally adjustable coupling drive 128 pivotally connects operating unit 127 to main machine frame 123 for intermittently advancing the operating unit while the main machine frame advances continuously. Ballast tamping assembly 133 and track leveling and lining assembly 134 are mounted on carrier frame means 126. Main machine frame 123 has its own track leveling reference system 135 extending between undercarriages 117, 118 and includes contact plates 136 carried by the track stabilization assembly for cooperation with the reference line of system 135 in the above-described manner.

Ballast compactors 137 comprising ballast compacting rollers are mounted at the rear of main machine frame 119 for compacting the shoulders of the stabilized track at the respective ends of the ties. Drives 138 connect the ballast compactors to the main machine frame for applying a vertical load to the compacting rollers.

Operating unit 127 has an optical reference system 139 comprising emitter 140 of light beam 141 associated with each rail and supported on undercarriage 124, and light beam receivers 142 supported on undercarriage 125. Track sensing element 143 is arranged for guidance on the track between ballast tamping assembly 133 and track leveling and lining assembly 134, and the track sensing element carries shadow boards 144 for cooperation with the light beams.

Ballast compactors 146 are mounted laterally adjacent ballast tamping assemblies 133 at the respective ends of the ties for compacting the ballast, the ballast compactors comprising plates connected to carrier frame means 126 by vertical pressure drives 145 and being preferably vibratory. These surface ballast compacts at the ends of the ties are operated at the same time as the tamping tools of the ballast tamping assembly while the continuously advancing ballast compactors 137 remain constantly in contact with the ballast.

In general, this machine operates in the same way as the above-described embodiments, drive 128 being a hydraulic cylinder-and-piston device and operating unit 127 being intermittently driven in the opposite direction of the main machine frame advance by applying hydraulic pressure to rear cylinder chamber 147 of the device. Lining reference system 148 of the machine extends from front undercarriage 124 to the rear end of the machine and cooperates with sensor 149 of track sensing element 143. It may be desirable, as described in connection with the embodiment of FIG. 1, to equip undercarriage 125 of the operating unit with its own drive and brake.

As described hereinabove, the power plant and control means for the ballast tamping, track leveling and lining and track stabilization assemblies are mounted on the main machine frame, which advances non-stop and carries the drive and brake means for the main machine frame, while the operating unit, which is longitudinally adjustably and pivotally connected thereto, carries the tamping, leveling and lining assemblies between two widely spaced undercarriages and is supported separately on the track on at least one undercarriage preceding the front undercarriage of the main machine frame and which may be intermittently driven. With this arrangement and despite the considerable weight of the main machine frame, the energy required for the continuous forward drive of the machine is relatively modest. Furthermore, structural parts which are sensitive to impacts and vibrations are protected because they are not subject to the constant stop-and-go movement of the operating unit. The various power and control means may be so distributed over the main machine frame that a desired load is supplied to its respective undercarriages and the hydraulic and electric operating lines are as short as possible. The undercarriages supporting the main machine frame and the carrier frame means of the operating unit may be of the same basic structure and all of them may be equipped with brake means. Where, as hereinabove described, the ballast tamping, track leveling and lining and track stabilization assemblies are of standard structure, available units may be used in the machine without requiring development work and new constructions. The same considerations apply to the use of conventional shoulder surface compactors. Where all the tools are hydraulically operated, a single hydraulic fluid source may be mounted on the main machine frame for supply to the power plant of the machine.

It is useful to synchronize the speeds of the drive for continuously advancing the main machine frame and the adjustment drive for intermittently advancing the operating unit. This assures a smooth advance of the main machine frame under extreme operating conditions, such as on hills and in curves, which will improve the comfort of the operators riding in the cabs on the main machine frame while, at the same time, assuring the most favorable intermittent advance of the operating unit for controlling the operation of the tools according to different track conditions.

Figures 10, 11, 12:
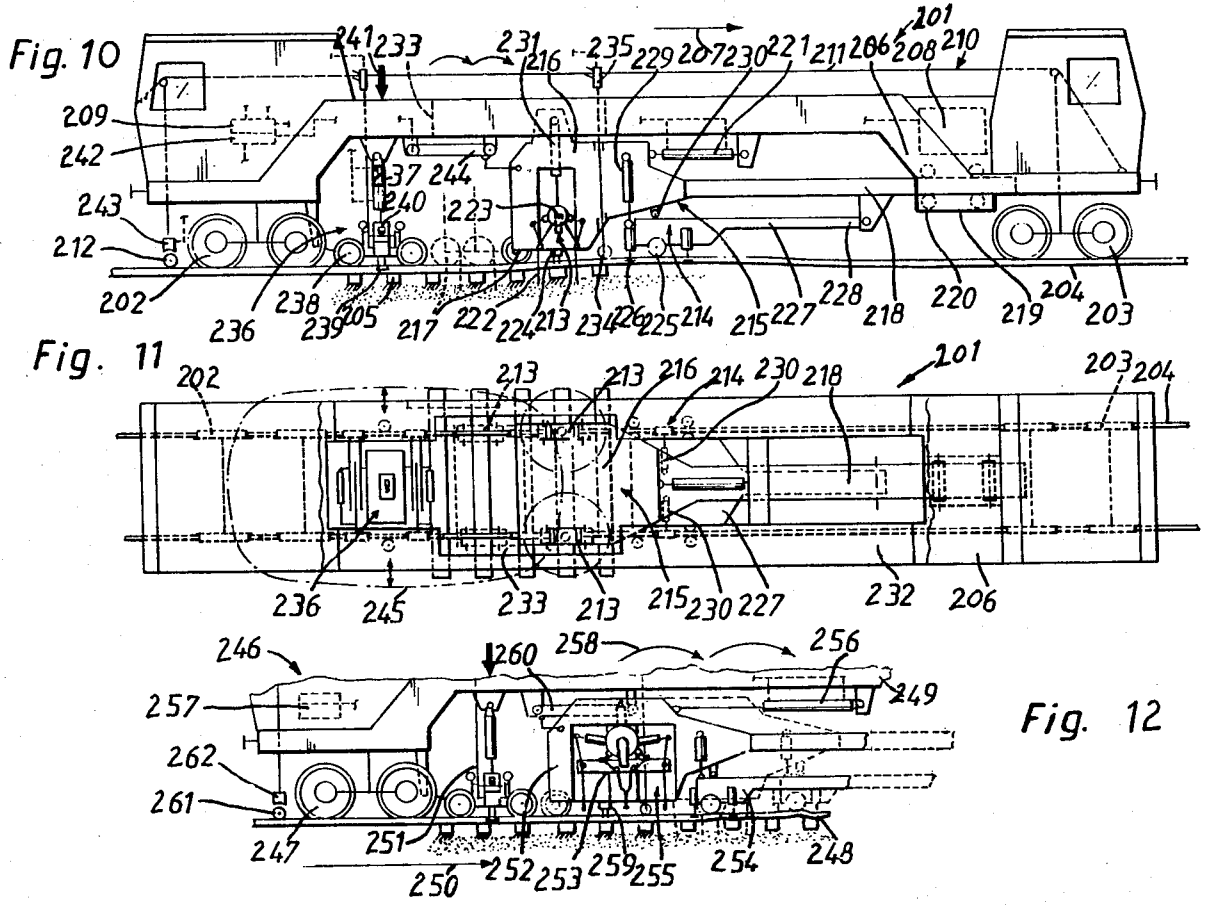
FIG. 10 is a side elevational view of yet another embodiment of the machine.
FIG. 11 is a schematic top view of FIG. 10.
FIG. 12 is a fragmentary side elevational view of still another embodiment with twin-tie tamping.

Referring now to FIGS. 10 and 11, there is shown mobile track tamping, leveling and lining machine 201 comprising machine frame 206 supported on two undercarriages, i.e. swivel trucks, 202 and 203 spaced apart in the direction of the track for mobility on the track in an operating direction indicated by arrow 207. In an altogether conventional manner, the machine frame carries power plant 208 and control means 209 for operating the various drives hereinafter described. Furthermore, machine 201 has conventional leveling reference system 210 (an equally conventional lining reference system not being further shown to simplify the drawing and description). This leveling system comprises a tensioned wire associated with each rail 204, the front ends of the wires being supported on front under-carriage 203 in a track section to be corrected while the rear ends of the tensioned wires are supported on track sensing element 212 immediately behind rear undercarriage 202 in a previously corrected track section. Intermediate track sensing element 234 measures the actual track position and supports sensor 235, such as a rotary potentiometer, associated with each tensioned wire for generating a leveling control signal in response to the measured actual track position. All of this is entirely conventional and will, therefore, not be described herein in detail.

According to the invention, operating unit 215 combined with this machine is comprised of ballast tamping assembly 213, track leveling and lining assembly 214, and common and separate carrier frame 216 supporting the assemblies. The ballast tamping assembly comprises a tamping tool carrier, drive 231 for vertically adjusting the tamping tool carrier, pairs of vibratory and reciprocatory tamping tools 222 mounted on the tamping tool carrier for immsersion in successive cribs, with a respective tie 205 positioned between tools 222 of the pairs, and drives 223 for vibrating and reciprocating the tamping tools. These drives include a vibrating drive rotating about an axis extending in the operating direction whereby vibrations in a direction transversely thereto are imparted to tamping tools 222. So as not to interfere with the operation of vertical adjusting drives 231, machine frame 206 comprised of two upwardly recessed elongated carrier beams 232 has an elongated recess 233 (shown schematically in broken lines) which receives drives 231. The track leveling and lining assembly is arranged forwardly of the ballast tamping assembly, in the operating direction 207, and comprises track-engaging lifting and lining tools, i.e. rollers, 225 and 226 as well as drives 229 and 230 for moving the lifting and lining tools respectively in a vertical and transverse direction for leveling and lining the track. Single-axle undercarriage 217 constituting a freely movable steering axle supports a rear end of carrier frame 216 on the track and pivotal bearing 219 supports front end 218 of the carrier frame on machine frame 206.

In the illustrated embodiment, single-axle undercarriage 217 has a single pair of flanged wheels for guidance along the track rails and carrier frame 216 has the form of a bogie with a pole constituting the front end thereof. Tamping assembly 213 is mounted at the rear end of the carrier frame and front end 218 is an elongated boom-shaped carrier and the pivotal bearing receives the boom-shaped carrier for displacement of the carrier frame in relation to the machine frame, sufficient lateral play being allowed for carrier 18 to pivot laterally and thus to permit undercarriage 217 to steer carrier frame 216 along the track in curves. The illustrated boom-shaped carrier is a beam of substantially rectangular cross section and the pivotal bearing is comprised of roller means consisting of two pairs of rollers 220 journaled on machine frame 206 and supporting the carrier for guidance during longitudinal displacement, the rollers engaging the upper surface and lower surface of the rectangular beam. The beam may be an I-beam with such upper and lower surfaces engaged by the rollers.

Power drive 221 links each end thereof by universal joints to carrier frame 216 and machine frame 205, respectively, this drive being a double-acting cylinder-and-piston device for displacement of the carrier frame in relation to the machine frame in the operating direction whereby the carrier frame may be advanced stepwise while the machine frame advances non-stop along the track.

Track leveling and lining assembly 214 also has bogie 227 with a rear portion supporting lifting rollers 226 and lining rollers 225, and pole 228 projecting forwardly from the rear portion and arranged below elongated front end 218 of carrier frame 216. The front end of pole 228 is linked to a bracket on carrier frame front end 218. Lifting drives 229 and lining drives 230 link bogie 227 to carrier frame 216.

Operating units of such structure and installed in track tamping, leveling and lining machines, as well as the advantages of various preferred structures described and illustrated in FIGS. 10–12, have been disclosed in considerable detail hereinabove as well as in my application Ser. No. 498,260, entitled "Track Tamping, Leveling and Lining Operating Unit" whose disclosure is incorporated herein by reference.

According to the invention, track stabilization assembly 236 is mounted on machine frame 206 between operating unit 215 and rear undercarriage 202 next adjacent thereto, the operating unit and the track stabilization assembly being arranged between front and rear undercarriages 203 and 202, in the operating direction. The generally conventional track stabilization assembly comprises a chassis, guide roller means including clamping rollers 238, 239 firmly holding the chassis in engagement with track rails 204, vibratory drive 240 imparting essentially horizontal vibrations to the chassis and the firmly held track, and power drive 237 connecting the chassis to machine frame 205 and arranged to impart essentially vertical load forces (indicated by arrow 241) to the chassis and the firmly held track.

Preferably, vibrating drive 223 for tamping tools 222 and vibrator drive 240 of the track stabilization assembly chassis are arranged to impart to the tamping tools and the chassis vibrations in phase with each other.

The illustrated machine also is equipped with a number of auxiliary operating devices designed to control the operation of the various operating tool movements automatically and in a desired sequence as machine 201 advances non-stop and operating unit 215 simultaneously advances stepwise from tamping point to tamping point. Preferably, these auxiliary devices provide a displacement path for power drive 221 for positioning carrier frame 216 in relation to machine frame 206 whose length is at least twice the average distance between ties 205 for enabling the machine frame to advance continuously and non-stop while the carrier frame advances stepwise. The double-acting cylinder-and-piston power drive comprises valve arrangement 242 connected to control 209 and controlling the piston movement of the drive synchronously with, but in the opposite direction of, the continuous and non-stop advance of the machine frame. As has been more fully described hereinabove, the auxiliary control devices connected to the valve arrangement include odometer 243 forming a structural unit with track sensing element 212 for measuring the advance of machine frame 206 and transmitting a control signal to valve arrangement 242 for each given unit of length the machine frame advances. The valve arrangement controls the flow of hydraulic fluid to the right cylinder chamber of drive 221 synchronously with, but in the opposite direction of, the machine frame advance in response to the odometer control signal so that carrier frame 216, with tamping assembly 214 centered over tie 205 being tamped, remains stationary until tamping has been completed while machine 1 advances continuously. When drive 231 raises the tamping tool carrier, a limit switch in the path of the vertical movement of the tamping tool carrier, will transmit a control signal to the valve arrangement for switching the hydraulic fluid flow into the left cylinder chamber of drive 221 so that the operating unit is rapidly advanced for centering the tamping assembly over the next tie to be tamped. When the tamping assembly is lowered again, odometer 243 is reset to the zero position so that a new operating cycle may be initiated. Alternatively and with substantially the same result, a cable line potentiometer 244 may be mounted on one of machine frame beams 232 for measuring the relative displacement between carrier frame 216 and machine frame 206 and transmitting a corresponding control signal to the valve arrangement. In this case, the piston movement of drive 221 is controlled proportionally to the displacement of a rod connected with carrier frame 216 and potentiometer 244, the output voltage of the potentiometer constituting an analog control signal. Finally, an inductive sensor 224 may be mounted on the tamping assembly for cooperation with ferrous rail fastening elements holding rails 204 on ties 205. As long as the inductive sensor is centered with respect to the associated rail fastening element during tamping, it remains neutral, i.e. inert. When it deviates from its centered position, sensor 224 transmits a control signal to valve arrangement 242 for changing the hydraulic fluid flow to drive 221. Thus, as more fully described in my concurrently filed application, machine 201 may be selectively operated with operating unit 215 moving relatively to machine frame 206 in the operating direction, i.e. with the machine advancing non-stop, or with machine frame 206 in unison with operating unit 215 advancing stepwise from tamping point to tamping point.

When control means 209 for the drives of stabilization assembly 336 and for leveling tool drive 229 is responsive to leveling reference system 210, the extent of the ballast settling obtained by the stabilization assembly may be so controlled in relation to the desired track level that the finished track level conforms most accurately to the desired level.

In FIG. 11, area 245 indicated by a chain-dotted line indicates the region in which the ballast is compacted and settled by the operation of the stabilization assembly, the double-headed arrows indicating the lateral vibrations imparted to the track by clamping rollers 239. Circles around ballast tamping assemblies 213 indicate the regions in which the ballast is tamped under tie 205 and, as shown, the compacting and tamping regions overlap. When vibrating drive 223 and vibrator drive 240 are set in operation at the same time, the vibrations they impart to the ballast will be in phase.

Track tamping, leveling and lining machine 246 of FIG. 12 has substantially the same structure and functions in an equivalent manner as that of FIG. 10, except for the different type of ballast tamping assembly 253 designed for the simultaneous tamping of two ties and the dimensioning of various parts required for accommodating such a tamping assembly. Again, machine frame 249 is supported on track 248 by two undercarriages 247 for mobility in an operating direction indicated by arrow 250. The track stabilization assembly 251 is again arranged between the rear undercarriage of the machine frame and operating unit 255 of this invention, which has carrier frame 252 for twin ballast tamping assembly 253 and for track leveling and lining assembly 254. Hydraulic displacement drive 256 connects carrier frame 252 to machine frame 249 and is actuated by control means 57. As indicated by arrows 258, operating unit 255 is advanced stepwise after each tamping cycle is completed by a considerable distance to reach the position for the next tamping cycle, while the machine frame advances non-stop, thus greatly increasing the efficiency of the operation. Inductive sensor 259, measuring potentiometer element 260 and sensing element 261 integrated with odometer 262 are again connected to control means 257 for operation in the above-indicated manner. The displaced position of the operating unit is schematically shown in broken lines.

What is claimed is:

1. A mobile track leveling, lining and tamping machine comprising a main machine frame supported on undercarriages spaced apart in the direction of the track for mobility on the track in an operating direction, the track consisting of two rails fastened to successive ties resting on ballast; an operating unit mounted for adjustment in relation to the main machine frame in the operating direction and comprised of a separate carrier frame means supporting a ballast tamping assembly and a track leveling and lining assembly forwardly of the ballast tamping assembly, in the operating direction, at a fixed distance from the tamping assembly; a pivotal bearing supporting a front end of the operating unit on the machine frame; a track stabilization assembly mounted on the main machine frame between the operating unit and a succeeding one of the undercarriages supporting the main machine frame on the track for continuous and non-stop movement therewith; a drive for continuously and non-stop advancing the main machine frame in the operating direction; and an adjustment drive for adjusting the operating unit in relation to the main machine frame for intermittently advancing the operating unit while the main machine frame advances continuously.

2. The mobile track leveling, lining and tamping machine of claim 1, wherein the ballast tamping assembly comprises a tamping tool carrier, a drive for vertically adjusting the tamping tool carrier, pairs of vibratory and reciprocatory tamping tools mounted on the tamping tool carrier for immersion in successive cribs, with a respective one of the ties positioned between the tools of the pairs; the track leveling and lining assembly comprises track engaging track lifting and lining tools and drives for moving the tools respectively in a vertical and transverse direction for leveling and lining the track; the track stabilization assembly comprises a chassis, guide roller means firmly holding the chassis in engagement with the track rails and mounting the chassis for mobility on the track, a vibrator drive imparting essentially horizontal vibrations to the chassis and the track firmly held thereby, and a power drive connecting the chassis to the main machine frame and arranged to impart essentially vertical load forces to the chassis and the track firmly held thereby; and further comprising a single-axle support and guide carriage constituting a freely movable steering axle supporting a rear end of the operating unit on the track, the track stabilization assembly being arranged between the freely movable steering axle and the succeeding undercarriage of the main machine frame; a leveling and lining reference system; and control means for operating the drives.

3. The track leveling, lining and tamping machine of claim 2, wherein the control means for the drives of the stabilization assembly and for the leveling and lining tools is responsive to the reference system.

4. The track leveling, lining and tamping machine of claim 1, wherein the adjustment drive is a hydraulic drive linking the operating structure to the main machine frame.

5. The track leveling, lining and tamping machine of claim 1, further comprising a single-axle support and guide carriage constituting a freely movable steering axle supporting a rear end of the operating unit on the track, the track stabilization assembly being arranged between the freely movable steering axle and the succeeding undercarriage of the main machine frame, and the carrier frame means being a frame including a centered, boom-shaped pole projecting forwardly in the operating direction from the tamping tool assembly, the tamping tool assembly being arranged between the forwardly projecting pole and the freely movable steering axle, and the pole longitudinally adjustably supporting the operating unit for pivoting in all directions.

6. The track leveling, lining and tamping machine of claim 5, wherein the pole has a rectangular or I-shaped cross-section, and the pivotal bearing comprises a roller guide on the main machine frame, the roller guide longitudinally adjustably supporting and guiding the pole.

7. The track leveling, lining and tamping machine of claim 5, wherein the the track leveling and lining assembly comprises a carrier frame, track engaging flanged rollers for lifting and lining the tracks and drives connecting the carrier frame of the track leveling and lining assembly to the frame of the tamping tool assembly for moving the carrier frame respectively in a vertical and transverse direction for leveling and lining the track, and a centered, boom-shaped pole projecting forwardly in the operating direction from the flanged rollers, the forwardly projecting pole of the carrier frame being pivotally connected to the pole of the frame supporting the tamping tool assembly.

8. The track leveling, lining and tamping machine of claim 1, wherein the adjustment drive has an adjustment path of at least twice the width of a crib.

9. The track leveling, lining and tamping machine of claim 1, wherein the adjustment drive comprises a double-acting hydraulic cylinder-and-piston device and a valve arrangement controlling the device synchronously with the drive for the main machine frame but in a direction opposite to the operating direction in which the main machine frame continuously advances.

10. The track leveling, lining and tamping machine of claim 1, wherein one of the undercarriages supporting the main machine frame for mobility on the track is positioned between the operating unit and the track stabilization assembly mounted on the main machine frame for movement therewith, the one undercarriage and the succeeding undercarriage immediately following each other and being spaced relatively far apart in the direction of the track.

11. The track leveling, lining and tamping machine of claim 10, further comprising a leveling and lining reference system; a power plant and control means for operating the drives of the stabilization assembly and for the leveling and lining tools, the control means being responsive to the reference system, the power plant, control means and the drive for advancing the main machine frame being mounted on the main machine frame, a support and guide carriage supporting a rear end of the operating unit on the track, the ballast tamping and track leveling and lining assemblies being mounted between the support and guide carriage and an undercarriage preceding the same in the operating direction, the support and guide carriage immediately preceding the one undercarriage in the operating direction.

12. The track leveling, lining and tamping machine of claim 10, wherein the main machine frame comprises, in the operating direction, a rear frame part extending between the one undercarriage and the succeeding undercarriage, the track stabilization assembly being mounted on the rear frame part, and a long front frame part extending between the one undercarriage and a front one of the undercarriages spaced from the one undercarriage in the direction of the track, the long front frame part having a rear end pivotally supported on the rear frame part whereby the main machine frame is articulated in the direction of the track and a front end supported on the front undercarriage, the operating unit being pivoted to the front frame part between the front and rear ends thereof.

13. The track leveling lining and tamping machine of claim 12, wherein two succeeding ones of said track stabilization assemblies are mounted on the rear frame part.

14. The track leveling, lining and tamping machine of claim 13, further comprising a pivotal support on the rear frame part, the pivotal support being substantially centered between the ends of the rear frame part for pivotally supporting the rear end of the long front frame part on the rear frame part.

15. The track leveling, lining and tamping machine of claim 12, wherein the carrier frame means of the operating unit is an elongated carriage supported for mobility on the track on two undercarriages spaced apart in the direction of the track, the carriage with the ballast tamping and track leveling and lining assemblies being arranged between the two undercarriages supporting the elongated carriage, the long front frame part bridging over the elongated carriage in the direction of the track, and the adjustment drive is a longitudinally adjustable coupling pivotally connecting the elongated carriage to the long front frame part and having an adjustment path corresponding to the path of intermittent advancement of the operating unit and about twice the distance between successive ties.

16. The track leveling, lining and tamping machine of claim 12, further comprising a central operator's cab mounted on the long front frame part between the track stabilization assembly and the ballast tamping and track leveling and lining assemblies, the cab projecting forwardly from a front end of the rear frame part in the operating direction and being arranged within direct sight of the assemblies.

17. The track leveling, lining and tamping machine of claim 10, wherein the ballast tamping assembly comprises a tamping tool carrier, a drive for vertically adjusting the tamping tool carrier, pairs of vibratory and reciprocatory tamping tools mounted on the tamping tool carrier for immersion in successive cribs, with a respective one of the ties positioned between the tools of the pairs; the track leveling and lining assembly comprises track engaging track lifting and lining tools and drives for moving the tools respectively in a vertical and transverse direction for leveling and lining the track; another one of the undercarriages is a front undercarriage supporting the main machine frame for mobility on the track; and further comprising a power plant for the drives of the ballast tamping and track leveling and lining assemblies mounted on the main machine frame between the track leveling and lining assembly and the front undercarriage.

18. The track leveling, lining and tamping machine of claim 17, further comprising a power plant for operating the track stabilization assembly mounted on the main machine frame between the one undercarriage and the succeeding undercarriage.

19. The track leveling, lining and tamping machine of claim 18, wherein the drive for continuously advancing main machine frame in the operating direction is connected at least to one of the last-mentioned undercarriages and is mounted on the main machine frame therebetween.

20. The track leveling, lining and tamping machine of claim 10, wherein the undercarriages supporting the main machine frame for mobility on the track include a front and a rear undercarriage in the operating direction, and further comprising a leveling reference system common to the track stabilization and track leveling assemblies, the common leveling reference system being arranged for non-stop movement with the main machine frame and extending between the front and rear undercarriages, the reference system comprising a respective sensing element guided on each rail for sensing the level of the respective rail within the range of the track stabilization assembly and the track leveling assembly, respectively, the sensing elements within the range of the track stabilization assembly moving continuously with said assembly and the sensing elements within the range of the track leveling assembly moving intermittently therewith.

21. The track leveling, lining and tamping assembly of claim 10, wherein the main machine frame is supported for continuous and non-stop advance on the one and succeeding undercarriages constituting the front and rear undercarriages of the main machine frame in the operating direction, and further comprising a power plant and control means for the track stabilization assembly as well as an operator's cab mounted on the main machine frame, the cab projecting forwardly from the front undercarriage in the operating direction; and the operating unit precedes the front undercarriage in the operating direction, two undercarriages supporting the carrier frame means for intermittent advance on the track and a rear end of the carrier frame means subtending the forwardly projecting operator's cab.

22. The track leveling, lining and tamping machine of claim 10, wherein the ballast tamping and track leveling and lining assemblies are arranged between two undercarriages, the distance between the one and succeeding undercarriages wherebetween the track stabilization assembly is mounted on the main machine frame and between the two undercarriages wherebetween the ballast tamping and track leveling and lining assemblies are mounted on the carrier frame means being substantially the same.

23. The track leveling, lining and tamping machine of claim 22, wherein the distance between the undercarriages is at least about 8 meters.

24. The track leveling, lining and tamping machine of claim 10, further comprising a central operator's cab mounted on the main machine frame within direct sight of the assemblies, additional operator's cabs mounted respectively at the front and rear ends of the main machine frame, with free views of the track in front and back of the main machine frame, brake means, and control means for the main machine frame drive and brake means mounted in the additional operator's cabs.

25. The track leveling, lining and tamping machine of claim 10, wherein the drive for continuously advancing the main machine frame and the adjustment drive are synchronized for adjusting the respective speeds of the continously advancing main machine frame and the intermittently advancing operating unit.

* * * * *